US010908539B2

(12) United States Patent
Taniguchi et al.

(10) Patent No.: US 10,908,539 B2
(45) Date of Patent: Feb. 2, 2021

(54) IMAGE HEATING DEVICE THAT PREVENTS FAILURE CAUSED BY INSUFFICIENT SUPPLY OF LUBRICANT AT ENDS PARTS

(71) Applicant: CANON KABUSHIKI KAISHA, Tokyo (JP)

(72) Inventors: Satoru Taniguchi, Mishima (JP); Munehito Kurata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/717,930

(22) Filed: Dec. 17, 2019

(65) Prior Publication Data

US 2020/0209787 A1 Jul. 2, 2020

(30) Foreign Application Priority Data

Dec. 27, 2018 (JP) ..... 2018-245432

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2025
See application file for complete search history.

(56) References Cited

U.S. PATENT DOCUMENTS

2005/0208398 A1* 9/2005 Ohmura ..... G03G 9/09783 430/45.55
2011/0052245 A1* 3/2011 Shinshi ..... G03G 15/2025 399/92
2015/0198919 A1* 7/2015 Lee ..... G03G 15/2025 399/329
2018/0259888 A1* 9/2018 Mitsui ..... G03G 15/2025
2020/0103793 A1* 4/2020 Takematsu ..... G03G 15/2025

FOREIGN PATENT DOCUMENTS

JP H0444075 A 2/1992
JP H0527619 A 2/1993

* cited by examiner

*Primary Examiner* — Carla J Therrien
(74) *Attorney, Agent, or Firm* — Canon U.S.A., Inc. I.P. Division

(57) ABSTRACT

A supporting member supporting a heating member includes a lubricant storage portion storing a lubricant on an upstream side of a nip portion in a rotation direction of an endless film sliding with respect to the heating member. The supporting member further includes a lubricant supplying portion supplying the lubricant stored in the lubricant storage portion to an inner peripheral surface of the film. An amount of the lubricant supplied from the lubricant supplying portion to the inner peripheral surface of the film per unit time is larger in an area through which a small-sized recording material smaller than a maximum-sized recording material fixable by the image heating device does not pass in a longitudinal direction than in an area through which the small-sized recording material passes.

16 Claims, 7 Drawing Sheets

IMAGE HEATING DEVICE THAT PREVENTS FAILURE CAUSED BY INSUFFICIENT SUPPLY OF LUBRICANT AT ENDS PARTS

BACKGROUND OF THE DISCLOSURE

Field of the Disclosure

The present disclosure relates to an image heating device serving as a fixing unit that heats and fixes an unfixed toner image formed on and carried by a recording material, in an image forming apparatus such as a multifunctional peripheral and a printer using an electrophotographic system or an electrostatic recording system.

Description of the Related Art

In an image heating device, for example, a heat roller system in which a nip portion that includes a heat roller and a pressurizing roller heats a recording material as a heated medium while nipping and conveying the recording material has been widely used. The heat roller serves as a heating member maintained at a predetermined temperature. The pressurizing roller serves as a pressurizing member that is pressed against with the heat roller.

In addition to the heat roller system, an image heating device of a film heating system has been devised (e.g., Japanese Patent Application Laid-Open No. H4-44075). The image heating device of the film heating system includes a heater as a heat source, a support (stay) of the heater, an endless heat-resistant film (hereinafter, film) that faces and comes into contact with the heater, and a pressurizing roller that brings a recording material into close contact with the heater through the film. In the image heating device of the film heating system, a nip portion, which includes the heater and the pressurizing roller, applies heat of the heater to the recording material through the film, thereby heating and fixing an unfixed image formed on and carried by a surface of the recording material to the surface of the recording material.

in the image heating device of the film heating system described above, a heater having a low heat capacity can be used. Thus, as compared with a device of the heat roller system, power saving and reduction of a wait time (reduction of first print output time) can be achieved.

Further, in the image heating device of the film heating system, there is known a configuration in which a lubricant is provided on an inner peripheral surface of the film to secure slidability between the inner peripheral surface of the film and a surface of the heater at the nip portion and to prevent rotation torque of the image heating device from increasing.

For example, there has been discussed a configuration in which a felt pad that is immersed with the lubricant such as fluorine grease and silicone oil in advance is provided on the surface of the heater to be in contact with the inner peripheral surface of the film to supply the lubricant to the inner peripheral surface of the film along with rotation of the film (Japanese Patent Application Laid-Open No. H5-27619). In the configuration, the felt pad is constantly immersed with the lubricant, and the lubricant is supplied from the felt pad to the inner peripheral surface of the film along with the rotation of the film.

In the configuration in which the lubricant is supplied to the inner peripheral surface of the film through a lubricant supplying portion like the felt pad, the rotation torque of the image heating device is reduced for a long term by maintaining a constant supply speed of the lubricant in a film longitudinal direction. The constant supply speed of the lubricant means that an amount of lubricant supplied to the inner peripheral surface of the film per unit time is fixed.

The image heating device of the film heating system performs fixing on a maximum-sized recording material (hereinafter, large-sized sheet) to which a formed toner image can be fixed and on a recording material having a width smaller than a width of the large-sized sheet (hereinafter, small-sized sheet). In a case of fixing a toner image formed on the small-sized sheet, unlike a case of fixing the toner image formed on the large-sized sheet, heat is not taken away by the recording material from an area through which the recording material does not pass (non-sheet-passing portion). Thus, temperature of the non-sheet-passing portion rises (temperature rise in non-sheet-passing portion) compared with that of an area through which the recording material passes (sheet-passing portion).

The lubricant provided on the inner peripheral surface of the film includes a base oil component that tends to be reduced as the temperature increases. If the large-sized sheet passes, a reduction amount of the base oil component in the lubricant is not different among positions arranged in the longitudinal direction since the temperature rise in the non-sheet-passing portion does not occur. On the other hand, if the small-sized sheet passes, the reduction amount of the base oil component in the lubricant at each of end parts becomes larger than the reduction amount thereof at a center part due to the temperature rise in the non-sheet-passing portion. Accordingly, in a case where a large number of small-sized sheets pass, the base oil component in the lubricant is reduced and becomes insufficient, which may deteriorate slidability or increase the rotation torque of the image heating device.

SUMMARY OF THE DISCLOSURE

The present disclosure is directed to an image heating device that can prevent failure caused by an insufficient supply of lubricant at end parts even in a case where a large number of toner images formed on small-sized sheets are fixed in a configuration in which the lubricant is supplied to an inner peripheral surface of a film.

According to an aspect of the present disclosure, an image heating device includes a heating member elongated in a longitudinal direction, a supporting member configured to support the heating member, an endless film configured to be guided by the supporting member and to be rotated around the heating member, and including an inner peripheral surface sliding with respect to the heating member, and a rotating member configured to come into contact with an outer peripheral surface of the film and form a nip portion that nips and conveys a recording material carrying an image while heating the recording material to fix a toner image. The supporting member includes a lubricant storage portion configured to store a lubricant on an upstream side of the nip portion in a rotation direction of the film. The supporting member further includes a lubricant supplying portion configured to supply the lubricant stored in the lubricant storage portion to the inner peripheral surface of the film. An amount of the lubricant supplied from the lubricant supplying portion to the inner peripheral surface of the film per unit time is larger in an area through Which a small-sized recording material smaller than a maximum-sized recording material fixable by the image heating device does not pass in the longitudinal direction than in an area through which the small-sized recording material passes.

Further features and aspects of the present disclosure will become apparent from the following description of example embodiments with reference to the attached drawings.

DESCRIPTION OF THE EMBODIMENTS

A first example embodiment of the present disclosure is described below with reference to drawings.

(1) Example Image Forming Apparatus

Figure 4:
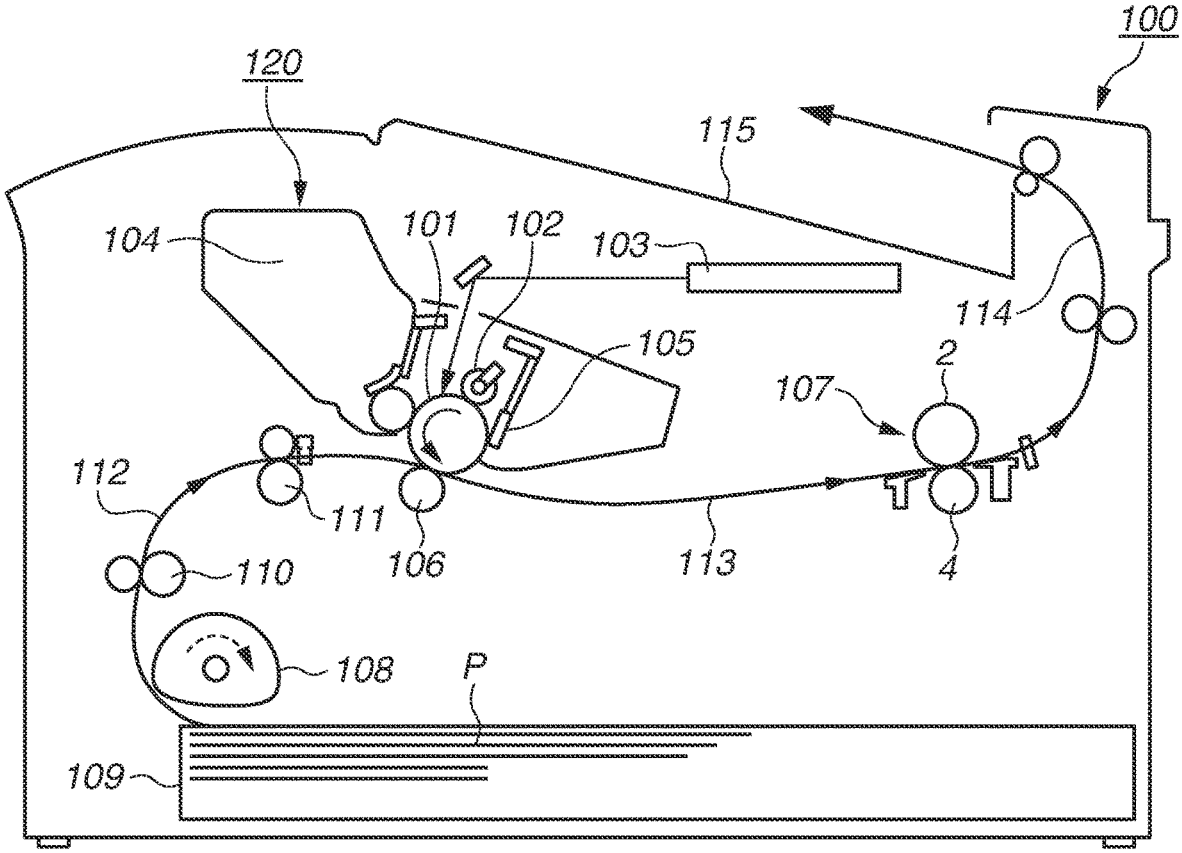
FIG. 4 is a configuration diagram schematically illustrating a main part of an image forming apparatus according to the example embodiment of the present disclosure.

FIG. 4 is a configuration diagram schematically illustrating an image forming apparatus including an image heating device according to the present example embodiment. In the present example embodiment, a laser printer using a transfer electrophotographic process is described as an example of an image forming apparatus 100.

The image forming apparatus 100 includes a cartridge 120 that includes a photoreceptor drum 101 as an image carrier, a charging unit 102 such as a contact charging roller, a developing device 104, and a cleaning device 105. The photoreceptor drum 101 is rotationally driven in a counter-clockwise direction illustrated by an arrow at a predetermined circumferential velocity (process speed). The charging unit 102 uniformly charges (primarily charges) a peripheral surface of the photoreceptor drum 101 at a predetermined polarity and potential. A charged surface of the primarily-charged photoreceptor drum 101 is scanned with and exposed to (irradiated with) a laser beam emitted from a laser scanner 103. The laser scanner 103 serving as an image exposure unit emits the laser beam that has been on/off modulated corresponding to a time-sequence electric digital pixel signal of target image information that is input from an external apparatus (not illustrated) such as an image scanner and a computer. As a result, an electric charge of an exposed bright part on the peripheral surface of the photoreceptor drum 101 is removed by the scanning and the exposure, and an electrostatic latent image corresponding to the target image information is formed.

The developing device 104 includes a developing sleeve that carries developer on a surface. The developer (toner) is supplied from the developing sleeve of the developing device 104, and the electrostatic latent image formed on the peripheral surface of the photoreceptor drum 101 is sequentially developed as a toner image. In a case of a laser printer, a reversal developing system that attaches the toner on the exposed bright part of the electrostatic latent image and performs development is commonly used.

Recording materials P are staked and stored in a sheet feeding cassette 109 that is attachable to and detachable from the image forming apparatus 100, The image forming apparatus 100 includes a sheet path 112 that includes a sheet feeding roller 108 for separating and feeding the recording materials P sheet by sheet, a conveyance roller 110 conveying the recording materials P, and a registration roller 111 for adjusting sheet feeding timing of the recording materials P. The recording materials P in the sheet feeding cassette 109 are separated and fed sheet by sheet when the sheet feeding roller 108 is driven in response to a sheet-feeding start signal. Each of the recording materials P passes through the sheet path 112 and enters a transfer portion, which includes the photoreceptor drum 101 and a transfer roller (transfer member) 106, at predetermined timing. In other words, conveyance of the recording material P is controlled by the registration roller 111 so that timing at which a leading end of the toner image on the photoreceptor drum 101 reaches the transfer portion coincides with timing at which a leading end of the recording material P reaches the transfer portion.

The recording material P that has entered the transfer portion is nipped and conveyed through the transfer portion while a transfer voltage (transfer bias) controlled to a predetermined voltage is applied from a transfer bias application power supply (not illustrated) to the transfer roller 106. As the transfer roller 106, an elastic sponge roller is commonly used. The elastic sponge roller has a semiconductive elastic sponge layer that has a resistance adjusted to about $1\times10^{6}\Omega$ to about $1\times10^{10}\Omega$ by using a carbon, an ion conductive filler, etc. formed on a core metal made of iron (Fe) or the like. In the present example embodiment, an ion conductive transfer roller in which an electroconductive elastic layer, which is obtained by reacting an acrylonitrile-butadiene rubber (NBR) and surfactant, is coaxially formed in a roller shape around a core metal is used. The used ion conductive transfer roller has a resistance value within a range from $1\times10^{8}\Omega$ to $5\times10^{8}\Omega$.

When a transfer bias opposite in polarity to the toner is applied to the transfer roller 106, the toner image formed on the peripheral surface of the photoreceptor drum 101 is electrostatically transferred to a front surface of the recording material P at the transfer portion. The recording material P to which the toner image has been transferred is conveyed from the transfer portion and is entered into an image heating device 107 through a sheet path 113, and fixing processing to heat and pressurize the toner image is performed on the recording material P. The recording material P to which the toner image has been fixed by the image heating device 107 passes through a sheet path 114 and is discharged from a discharge port to a discharge tray 115. Thus, the image formation is completed.

On the other hand, after the toner image is transferred to the recording material P, untransferred toner and paper dust on the peripheral surface of the photoreceptor drum 101 are removed by the cleaning device 105 including a blade. Then, the peripheral surface of the photoreceptor drum 101 is primarily charged again and is used for next image formation.

(2) Example Image Heating Device

Figure 1:
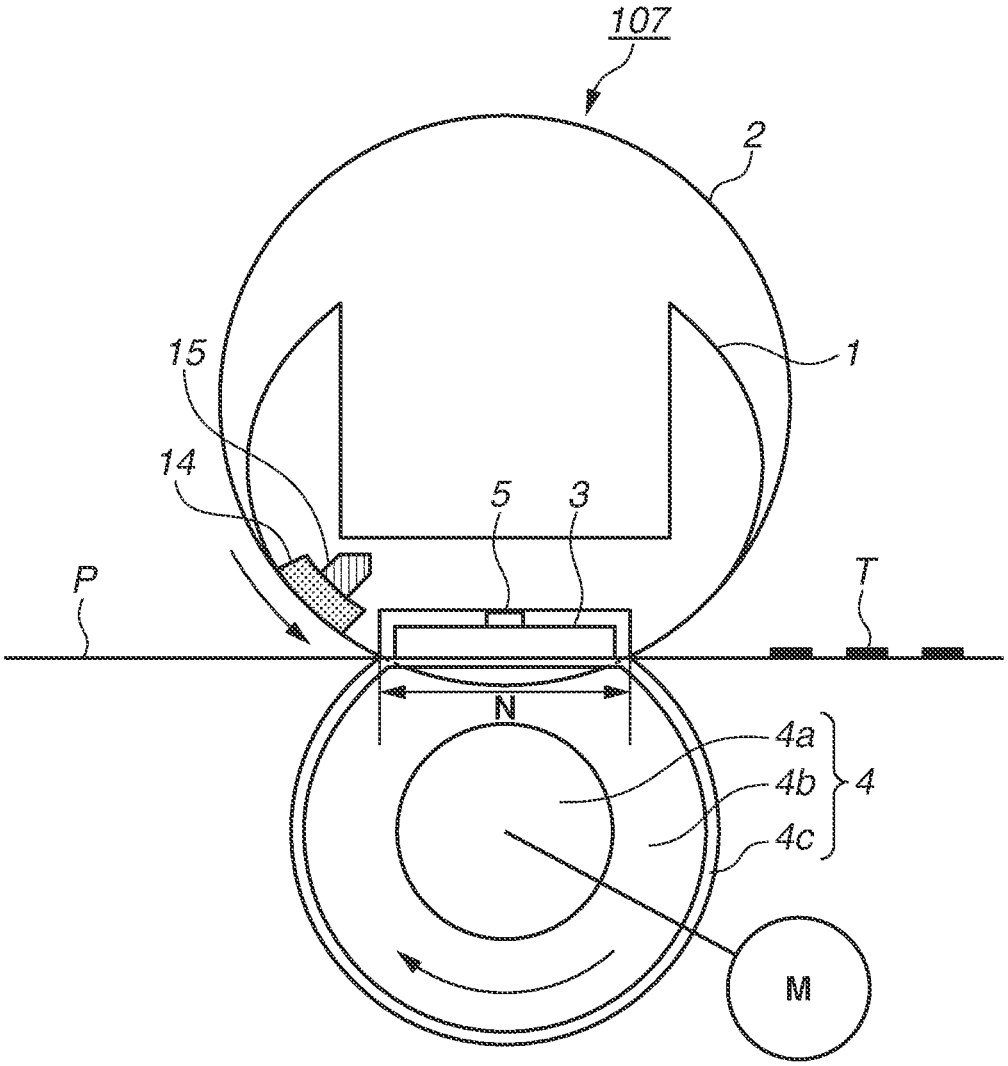
FIG. 1 is a configuration diagram schematically illustrating a main part of an image heating device according to an example embodiment of the present disclosure.

Next, the image heating device 107 according to the present example embodiment is described. FIG. 1 is a configuration diagram schematically illustrating the image heating device 107 of a film heating system according to the present example embodiment.

The image heating device 107 includes a heater (heating member) 3, a stay (supporting member) 1 holding the heater 3, a film 2 that is rotated around the stay 1 while coming in contact with the heater 3, and a pressurizing roller (rotating member) 4 that forms a nip portion N between the heater 3 and the pressurizing roller 4 with the film 2 in between.

The stay 1 is a member that has heat resistance and rigidity, and provides a supporting function of holding the heater 3 and a film guiding function of guiding rotation of the film 2. The stay 1 is made of a high heat-resistant resin such as polyimide, polyamide-imide, polyether ether ketone (PEEK), polyphenylene sulfide (PPS), and liquid crystal polymer, or a composite material of any of these resins with a ceramic, metal glass, or the like. The liquid crystal polymer is used in the present example embodiment.

The film 2 is externally fitted to the stay 1, which holds the heater 3 and functions as the film guiding member, and is rotatable around the stay 1 while an inner peripheral surface of the film 2 is in contact with the heater 3. An inner peripheral length of the film 2 is made to be larger by, for example, about 3 mm than an outer peripheral length of the stay 1 holding the heater 3 so that the film 2 is externally fitted to the stay 1 with slack. Accordingly, in the present example embodiment, the endless film 2 is in a state where tension is not applied at all times. The film 2 preferably has a thickness of 20 μm or more and 45 μm or less to reduce a heat capacity and reduce a wait time (first print output time). As the film 2, a heat-resistant single layer film of polytetrafluoroethylene (PTFE), perfluoro alkoxy alkane (PFA), or perfluoro ethylene propylene copolymer (FEP), or a multilayer film in which a film made of polyimide, polyimide-imide, PEEK, polyether sulfone (PES), or PPS is coated with PTFE, PEA, FEP, or the like can be used. In the present example embodiment, a polyimide film that has a film thickness of about 60 μm and has an outer peripheral surface coated with PEA is used. A thickness of the PFA coating layer is about 15 μm. An outer diameter of the film 2 is 24 mm, a base layer of the film 2, a metal material such as stainless steel (SUS) can also be used besides the above-described resin materials. To improve image quality, a heat-resistant rubber layer of silicone rubber or the like may also be formed as an elastic layer between the base layer and the coating layer.

The pressurizing roller 4 as a driving unit of the film 2 nips the film 2 between the pressurizing roller 4 and the heater 3 to form the nip portion N, and rotates the film 2. The pressurizing roller 4 includes a core metal 4*a*, an elastic body layer 4*b*, and an outermost surface layer 4*c*, and is disposed so as to press against a surface of the heater 3 through the film 2 at a predetermined pressing force by an urging unit acting on a bearing (not illustrated). In the present example embodiment, an aluminum core metal is used as the core metal 4*a*, silicone rubber is used for the elastic body layer 4*b*, and a PFA tube having a thickness of about 50 μm is used as the surface layer 4*c*. An outer diameter of the pressurizing roller 4 is 25 mm, and a thickness of the elastic body layer 4*b* is about 3 mm.

The pressurizing roller 4 is rotationally driven by a motor M in a clockwise direction indicated by an arrow at a predetermined circumferential velocity. The film 2 is driven and rotated by receiving rotating force transmitted from the pressurizing roller 4 to the film 2 by friction force acting between the pressurizing roller 4 and the outer peripheral surface of the film 2 at the nip portion N while the inner peripheral surface of the film 2 slides on the heater 3 at the nip portion N. Accordingly, the film 2 is moved and rotated around the stay 1 in a counterclockwise direction at a speed substantially the same as a moving speed of a peripheral surface of the pressurizing roller 4.

Figure 6:
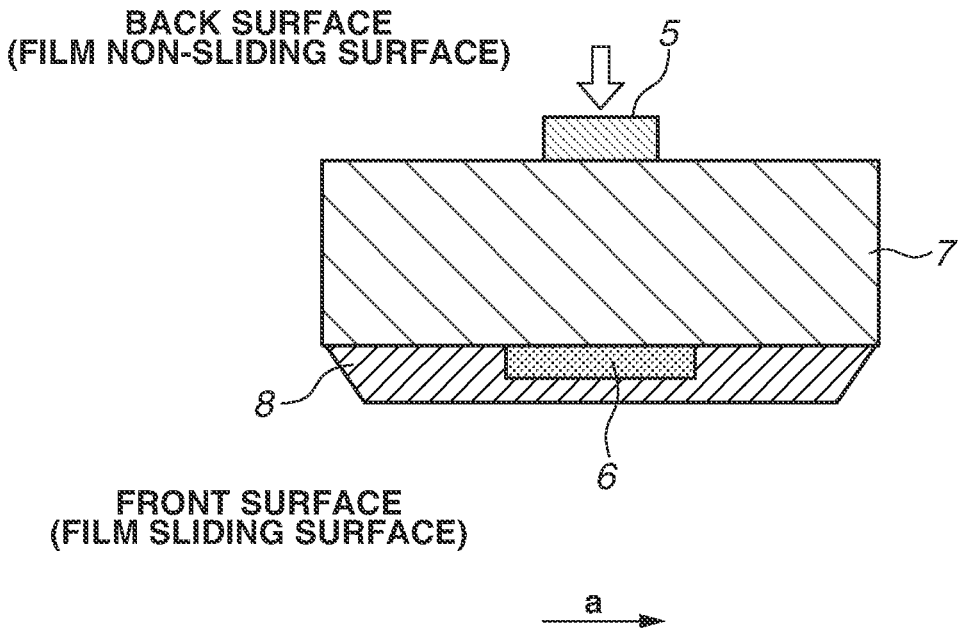
FIG. 6 is a cross-sectional view of the heater according to the example embodiment of the present disclosure.

As the heater 3, a ceramic heater is specifically used, which is disposed on a bottom surface of the stay 1 along a longitudinal direction of the stay 1 and is held by the stay 1. FIG. 6 is a cross-sectional view of the heater 3 according to the present example embodiment. The heater 3 includes a substrate 7, a resistance heating element 6 formed on a film sliding surface of the substrate 7, an insulation protective layer 8 that protects a heater surface provided with the resistance heating element 6, and power supplying electrodes 9 and 10 provided at longitudinal end parts of the resistance heating element 6. The heater 3 is held and fixed on the bottom surface of the stay 1 in a state where a front surface of the substrate 7, on which the resistance heating element 6 and the insulation protective layer 8 are provided, faces downward to face the film 2.

The substrate 7 has an elongated shape extending in a direction orthogonal to a conveyance direction of the recording material P as a longitudinal direction, and is made of a material having heat resistance, insulation properties, and thermal conductivity. For example, a ceramic material such as aluminum oxide and aluminum nitride is used for the substrate 7 having the heat resistance and insulation properties. The resistance heating element 6 is formed on the substrate 7 by screen printing with a paste that is prepared by kneading silver-palladium, glass powder (inorganic binder), and an organic binder. The insulation protective layer 8 is formed so as to cover the resistance heating element 6 provided on the substrate 7, and is configured so as to secure slidability between the surface of the heater 3 and the film 2 in addition to electric insulation between the surface of the heater 3 and outside. In the present example embodiment, a heat-resistant glass layer is used as the insulation protective layer 8. A screen printed pattern of silver is used for each of the power supplying electrodes 9 and 10. Since the power supplying electrodes 9 and 10 are provided to supply power to the resistance heating element 6, the resistance of each of the power supplying electrodes 9 and 10 is made to be sufficiently lower than the resistance of the resistance heating element 6.

Figure 5:
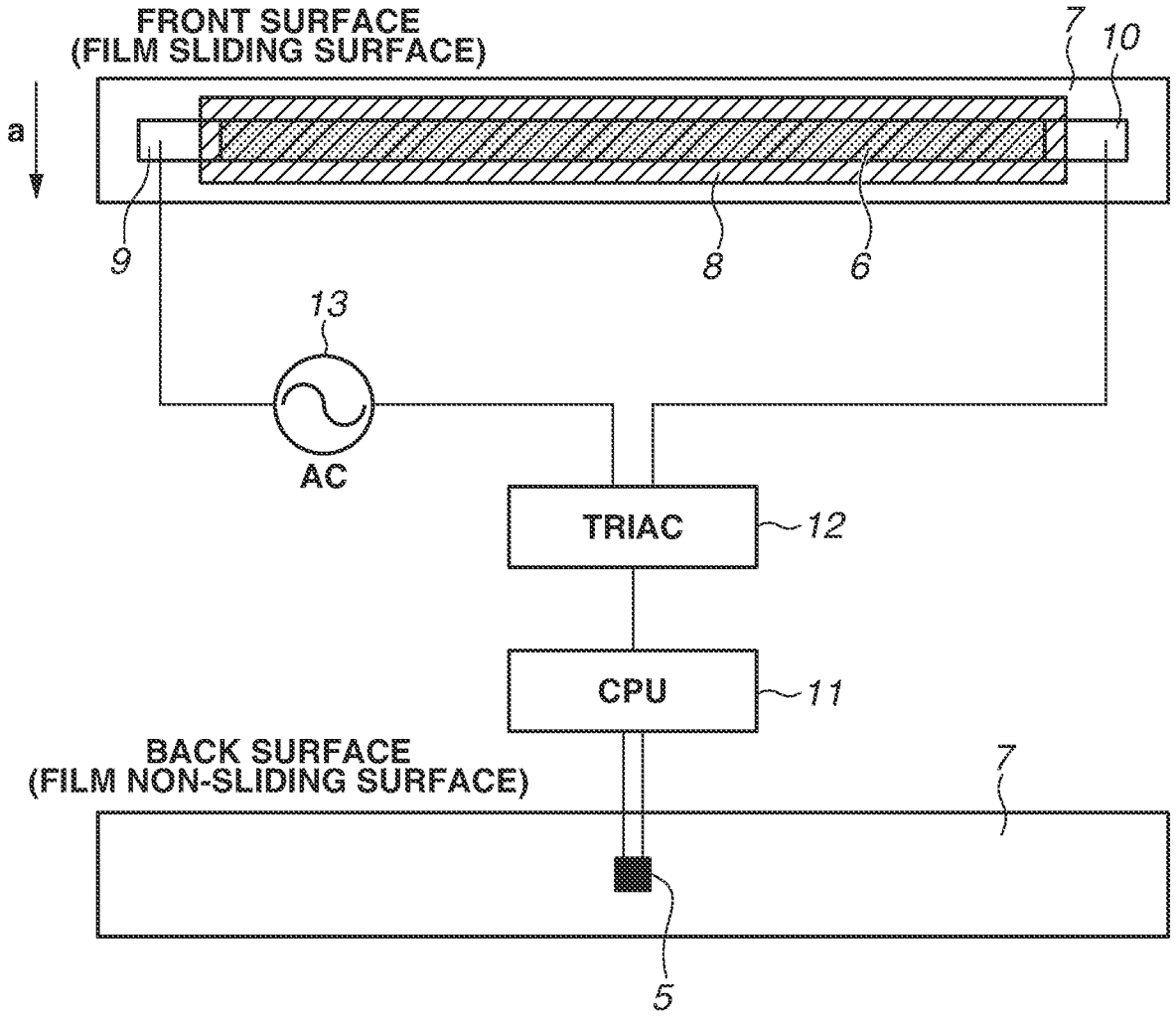
FIG. 5 is a front view of a heater according to the example embodiment of the present disclosure.

Temperature of the heater 3 can be detected by a temperature detection element (thermistor) 5. In the present example embodiment, an externally-contacting thermistor separate from the heater 3 is used as the temperature detection element 5. The temperature of the heater 3 rises when power is supplied to the power supplying electrodes 9 and 10 of the resistance heating element 6 and the resistance heating element 6 generates heat over the entire longitudinal length thereof. As illustrated in FIG. 5, a temperature rise of the heater 3 is detected by the thermistor 5, an output of the thermistor 5 is analog-digital (A/D) converted and is input to the CPU 11. Based on the information, power to be supplied to the resistance heating element 6 is controlled through phase control and wavenumber control by a triac 12. As a result, the temperature of the heater 3 is controlled, in other words, the supplied power is controlled so that the temperature of the heater 3 is raised if the temperature detected by the thermistor 5 is lower than a predetermined set temperature and the temperature of the heater 3 is lowered if the temperature detected by the thermistor 5 is higher than the predetermined set temperature, to maintain the heater 3 at the constant temperature in fixing.

After the temperature of the heater 3 is raised to the predetermined temperature and the film 2 is driven and rotated by the pressurizing roller 4, the recording material P to which the toner image has been transferred is conveyed from the transfer portion to the nip portion N including the heater 3 and the pressurizing roller 4 with the film 2 in between. Then, when the recording material P and the film 2 are nipped and conveyed through the nip portion N, the heat of the heater 3 is applied to the recording material P through the film 2, and the unfixed toner image on the recording material P is heated and pressurized to be fixed to the recording material P. The recording material P that has passed through the nip portion N is separated from the film 2 and is further conveyed.

(3) Example Lubricant Storage Portion and Lubricant Supplying Portion

Next, a lubricant storage portion and a lubricant supplying portion according to the present example embodiment are described. In the present example embodiment, as illustrated in FIG. 1, the stay 1 includes a lubricant storage portion 15 on an upstream side of a holding unit of the heater 3 in a rotation direction of the film 2, and lubricant is stored in the lubricant storage portion 15. A sheet-like lubricant supplying portion 14 is disposed and bonded so as to cover an opening of the lubricant storage portion 15 and to come into contact with the inner peripheral surface of the film 2. The lubricant supplying portion 14 is preferably a fiber layer such as a felt layer, and examples of a material thereof include aramid fiber, glass fiber, and carbon fiber. In the present example embodiment, aramid fiber felt is used. As the lubricant, a heat-resistant lubricant, for example, a grease obtained by thickening perfluoropolyether base oil with fluororesin, or silicone oil such as dimethyl silicone oil can be used. In the present example embodiment, the grease obtained by thickening perfluoropolyether base oil with fluororesin is used.

Figure 2:
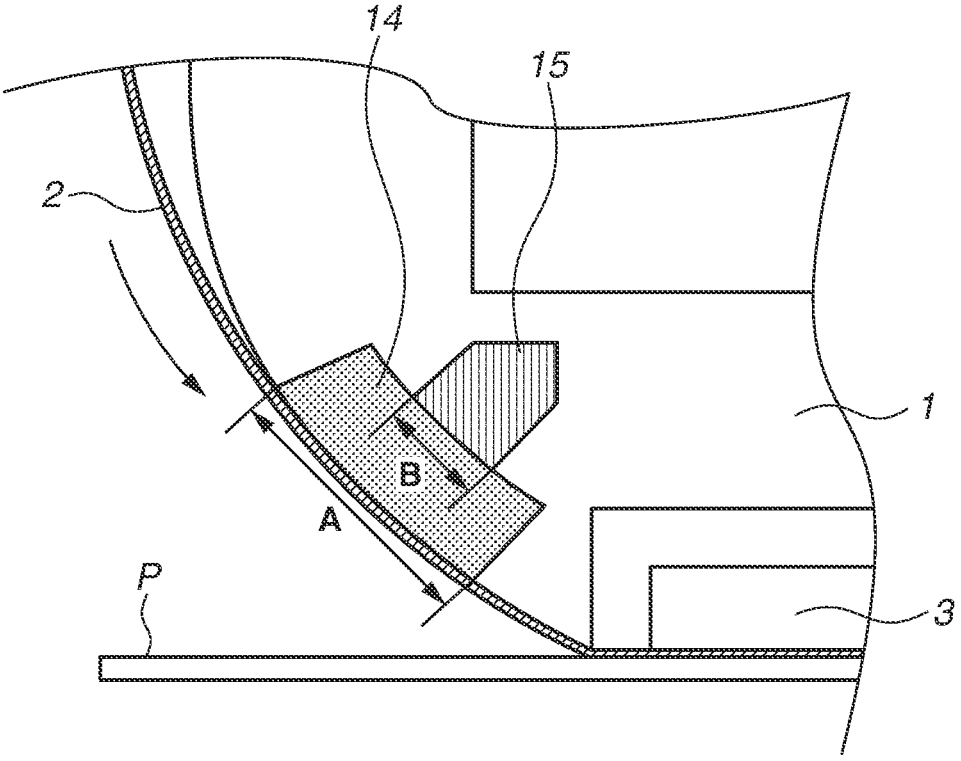
FIG. 2 is an enlarged cross-sectional view of the image heating device according to the example embodiment of the present disclosure.

FIG. 2 is an enlarged cross-sectional view illustrating a vicinity of the lubricant storage portion 15 and the lubricant supplying portion 14. The lubricant stored in the lubricant storage portion 15 flows toward the opening by gravity and its own weight. Thus, the lubricant supplying portion 14 is impregnated with the lubricant at the opening so that the lubricant can pass through the lubricant supplying portion 14. Since the lubricant supplying portion 14 is in contact with the film 2, the lubricant permeating through the lubricant supplying portion 14 is supplied to the inner peripheral surface of the film 2 along with rotation of the film 2. The lubricant is supplied to the inner peripheral surface of the film 2, which makes it possible to secure slidability between the film 2 and the heater 3 at the nip portion N. In FIG. 2, an opening width (gap) of the opening of the lubricant storage portion 15 in the rotation direction of the film 2 is indicated by B, and a length of the peripheral surface of the film 2. In an area where the film 2 is in contact with the lubricant supplying portion 14 in the rotation direction of the film 2 is indicated by A.

As a consistency of the lubricant is higher (i.e., viscosity is lower) and a density of the lubricant supplying portion 14 made of the same material is lower, the lubricant supplying portion 14 is easily impregnated with the lubricant and an amount of the lubricant supplied to the film 2 per unit time (hereinafter, supply speed) is increased. Further, the supply speed of the lubricant becomes higher as an area (proportional to distance B) of the opening of the lubricant storage portion 15 is larger and a contact area (proportional to distance A) of the lubricant supplying portion 14 with the film 2 is larger.

If factors that determine the above-described supply speed of the lubricant are the same in the film longitudinal direction, the lubricant is supplied to the film 2 at the same supply speed in the longitudinal direction. In a case where only a large-sized sheet that is a maximum size fixable by the image heating device 107 passes, the above-described temperature rise in the non-sheet-passing portion hardly occurs. Thus, there is no difference in a reduction amount of the lubricant, more specifically, the base oil component of the lubricant among positions arranged in the longitudinal direction. However, in a case where a large number of small-sized sheets pass, the base oil component of the lubricant at each of the end parts is reduced compared with that at a center part in the longitudinal direction due to influence of the temperature rise in the non-sheet-passing portion, and the lubricant (base oil component) becomes insufficient at each of the end parts in the longitudinal direction. This may deteriorate slidability.

Figure 3:
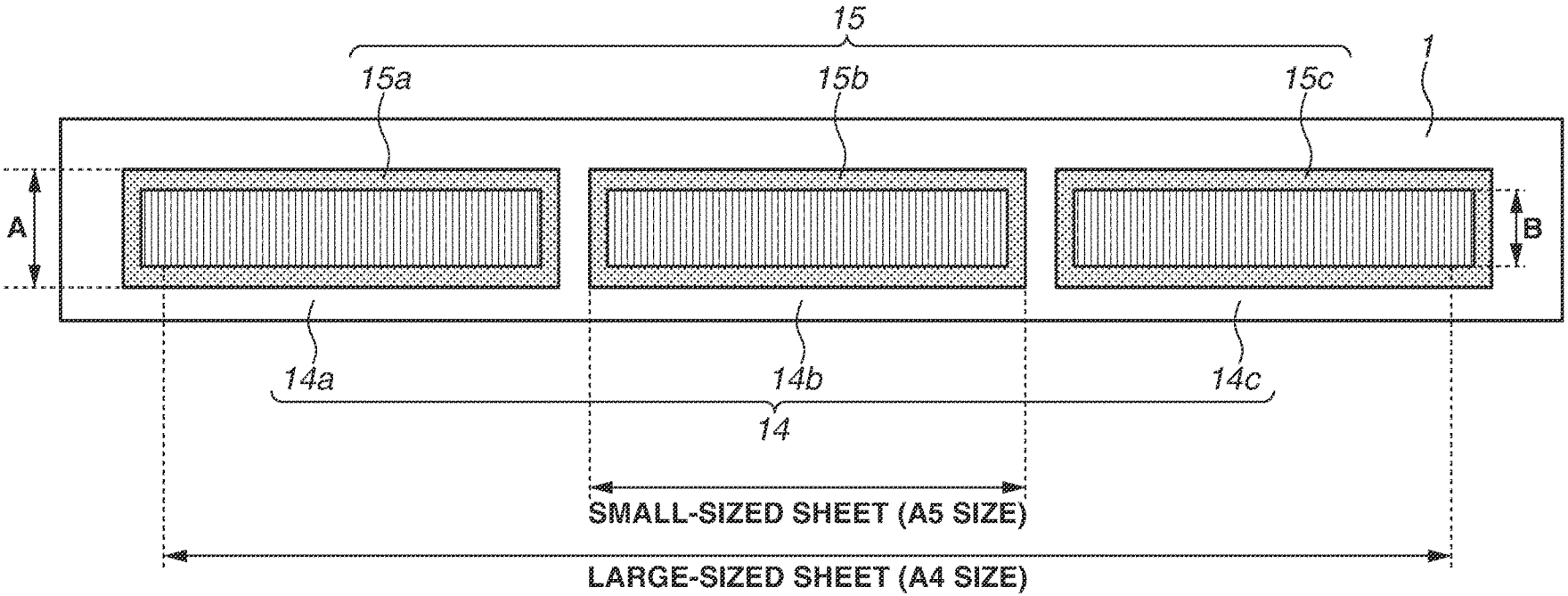
FIG. 3 is a diagram illustrating a longitudinal layout of a lubricant storage portion and a lubricant supplying portion according to a first example embodiment.

Accordingly, the supply speed of the lubricant is made higher at the end parts than the center part in the longitudinal direction, and a supply amount of the lubricant is made larger at the end parts than the center part in the longitudinal direction. As a result, even in a case where the temperature rise in the non-sheet-passing portion occurs and the base oil component of the lubricant is reduced at the end parts compared with the center part, it is possible to suppress deterioration of slidability at the end parts in the longitudinal direction, More specifically, in the present example embodiment, the density of the lubricant supplying portion 14 is made different between the center part and the end parts in the longitudinal direction so that the supply amount of the lubricant is larger at the end parts than at the center part in the longitudinal direction. FIG. 3 is a diagram illustrating a layout of the lubricant storage portion 15 and the lubricant supplying portion 14 in the longitudinal direction according to the present example embodiment.

In the present example embodiment, the lubricant storage portion 15 and the lubricant supplying portion 14 are each divided into three parts in the longitudinal direction. More specifically, the lubricant supplying portion 14 includes a lubricant supplying portion 14*b* located at the center part of the stay 1 in the longitudinal direction, and lubricant supplying portions 14*a* and 14*c* located at the respective end parts. The lubricant storage portion 15 includes a lubricant storage portion 15*b* located at the center part of the stay 1 in the longitudinal direction, and lubricant storage portions 15*a* and 15*c* located at the end parts. The lubricant storage portions 15*a* and 15*c* and the lubricant supplying portions 14*a* and 14*c* that are located at the end parts of the stay 1 in the longitudinal direction are each configured so that an outer end extends to outside of a sheet end of the large-sized sheet (A4 size). Further, the lubricant storage portions 15*a* and 15*c* and the lubricant supplying portions 14*a* and 14*c* that are located at the end parts of the stay 1 in the longitudinal direction are each configured so that an inner end extends to a sheet end of the small-sized sheet (A5 size). In other words, the lubricant storage portions 15*a* and 15*c* and the lubricant supplying portions 14*a* and 14*c* that are located at the end parts of the stay 1 in the longitudinal direction are disposed at positions corresponding to areas through which the large-sized sheet passes but the small-sized sheet does not pass. The lubricant supplying portion 14*b* located at the center part of the stay 1 in the longitudinal direction has a length corresponding to a sheet width of the small-sized sheet (A5 size) in the longitudinal direction, and is disposed at a position corresponding to a sheet-passing portion through which both the large-sized sheet and the small-sized sheet pass. In the present example embodiment, a conveyance position of the recording material in the longitudinal direction is based on a center alignment in which a center of the sheet in the sheet width direction is aligned in any of the large-sized sheet and the small-sized sheet.

In the present example embodiment, an opening of each of the lubricant storage portions 15*a* and 15*c* located at the longitudinal end parts and an opening of the lubricant storage portion 15*b* located at the center part of the stay 1 in the longitudinal direction have the same area. More specifically, the lubricant storage portions 15*a*, 15*b*, and 15*c* have the same length in the longitudinal direction, and the opening width (gap) B of the opening of the lubricant storage portion 15 in the rotation direction of the film 2 is set to 3.0 mm. Further, a contact area of the film 2 with the lubricant supplying portion 14*b* located at the center part of the stay 1 in the longitudinal direction and a contact area of the film 2 with each of the lubricant supplying portions 14*a* and 14*c* located at the longitudinal end parts are equal to each other. More specifically, the lubricant supplying portions 14*a*, 14*b*, and 14*c* have the same length in the longitudinal direction, and the length A of the peripheral surface of the film 2 in each of the contact areas of the film 2 with the lubricant stippling portions 14*a*, 14*b*, and 14*c* in the rotation direction of the film 2 is set to 4.5 mm.

As described above, in the present example embodiment, the lubricant supplying portions 14*a*, 14*b*, and 14*c* have the same length in the longitudinal direction, and the contact areas of the film 2 with the lubricant supplying portions 14*a*, 14*b*, and 14*c* located at the center part and the end parts of the stay 1 in the longitudinal direction are equal to one another. The lubricant stored in the lubricant storage portions 15*a*, 15*b*, and 15*c* provided at the center part and the end parts of the stay 1 in the longitudinal direction has the same consistency, and the used lubricant has a ½-scale incorporation consistency of 280 measured by a method specified by JIS K 2220.

In the present example embodiment, the densities of the fibers of the lubricant supplying portions 14*a* and 14*c* located at the end parts of the stay 1 in the longitudinal direction (longitudinal end parts) are lower than the density of the fibers of the lubricant supplying portion 14*b* located at the center part in the longitudinal direction (longitudinal center part). Accordingly, the supply speed of the lubricant supplied through the lubricant supplying portions 14*a* and 14*c* located at the longitudinal end parts can be made higher than the supply speed of the lubricant supplied through the lubricant supplying portion 14*b* located at the longitudinal center part. As a result, even in the case where a large number of small-sized sheets pass, it is possible to prevent deterioration of slidability at the longitudinal end parts due to insufficiency of the lubricant.

The supply speed of the lubricant at the longitudinal center part is set to an appropriate speed taking into consideration a lifetime of the image heating device, an amount of the lubricant stored in the lubricant storage portion 15, and an amount of the lubricant to be supplied to the film 2 to secure slidability. More specifically, to set the appropriate speed, the consistency of the lubricant, the density of the lubricant supplying portion 14, the area of the opening of the lubricant storage portion 15, and the contact area of the lubricant supplying portion 14 with the film 2 are adjusted. The density of the lubricant supplying portion 14*b* at the center part is preferably set to about 30 g/m$^2$ to about 700 g/m$^2$ at the thickness of 1 mm, and in the present example embodiment, the density thereof is set to 200 g/m$^2$ at the thickness of 1 mm. Accordingly, in the present example embodiment, the supply speed of the lubricant at the longitudinal center part is set to 0.16 mg/h. The supply speed described here is defined based on a weight of the lubricant supplied to the film 2 per one hour in an area having a unit length of 10 mm in the longitudinal direction. On the other hand, the supply speed of the lubricant at the longitudinal end parts can be increased by a necessary amount relative to the supply speed of the lubricant at the center part by reducing the density of each of the lubricant supplying portions 14*a* and 14*c*, which are made of the same material as the lubricant supplying portion 14*b*, in consideration of a degree of the temperature rise in the non-sheet-passing portion of the image heating device. The density of each of the lubricant supplying portions 14*a* and 14*c* at the longitudinal end parts is preferably set to about 30 g/m$^2$ to about 700 g/m$^2$ at the thickness of 1 mm, and in the present example embodiment, the density thereof is set to 170 g/m$^2$ at the thickness of 1 mm. Accordingly, the supply speed of the lubricant at the longitudinal end parts is set to 0.19 mg/h that is about 1.2 times the supply speed of the lubricant at the longitudinal center part.

To solve the issue of insufficiency of the lubricant at each of the longitudinal end parts due to the temperature rise in the non-sheet-passing portion when the large number of small-sized sheets pass, the supply speed of the lubricant may be uniformly increased over the lubricant supplying portion 14 in the longitudinal direction. However, in this case, the lubricant is excessively supplied at the portion located at the longitudinal center part, thereby causing waste of the lubricant. In addition, the heat capacity of the image heating device 107 is increased by an excess amount of the lubricant, which increases the wait time (first print output time). Accordingly, as in the present example embodiment, the supply speed of the lubricant at the center part of the stay 1 in the longitudinal direction is preferably matched to reduction of the base oil component of the lubricant estimated at the sheet-passing portion, and the supply speed of the lubricant at each of the end parts of the stay 1 in the longitudinal direction is preferably matched to reduction of the base oil component of the lubricant estimated at the non-sheet-passing portion.

(4) Comparative Experiment

A comparison result of durability of the image heating device between the configuration according to the present example embodiment and a configuration according to a conventional example is described below. The conventional example had the configuration similar to the configuration according to the present example embodiment except that the aramid fiber felt having the density of 200 g/m$^2$ at the thickness of 1 mm was used not only for the lubricant supplying portion 14*b* at the longitudinal center part but also for the lubricant supplying portions 14*a* and 14*c* at the longitudinal end parts. In other words, in the configuration according to the conventional example, the supply speed of the lubricant at each of the longitudinal center part and the longitudinal end parts was set to 0.16 mg/h, and the supply speed was uniform over the lubricant supplying portion 14 in the longitudinal direction. In the verification, durability tests were conducted using a case where only recording materials of A4 size passed and a case where the recording materials of A4 size and the recording materials of A5 size passed half and half. A comparison was performed about the number of sheets passed before failure had occurred. More specifically, the durability test was performed in which a cycle of passing 500 sheets of the recording materials of A4 size and passing of 500 sheets of the recording materials of A5 size was repeated. Table 1 illustrates the result.

TABLE 1

| Durability Test Result | | |
|---|---|---|
| Image Heating Device | Passing Only A4 Size Sheets | Passing A4 Size Sheets and A5 Size Sheets |
| Conventional Example | No Failure Occurred by Passing 100,000 Sheets | Conveyance Failure Occurred by Passing 60,000 Sheets |
| Present Example Embodiment | No Failure Occurred by Passing 100,000 Sheets | No Failure Occurred by Passing 100,000 Sheets |

First, in the test in which only the recording materials of A4 size passed, no failure occurred up to passing of 100,000 sheets both in the image heating device according to the conventional example and in the image heating device according to the present example embodiment. On the other hand, in the test in which the recording materials of A4 size and the recording materials of A5 size passed half and half, a conveyance failure of the recording material occurred after passing of 60,000 sheets in the image heating device according to the conventional example, whereas no failure occurred even up to passing of 100,000 sheets in the image heating device according to the present example embodiment. In the image heating device according to the conventional example, the supply speed of the lubricant was uniform in the longitudinal direction. Thus, the base oil component of the lubricant was easily reduced at the non-sheet-passing portion when the recording materials of A5 size passed, and torque was partially increased. When the recording materials of A4 size passed in this state, the rotation of the film 2 became unstable due to an influence of the increase of the torque, which caused the conveyance failure of the recording material.

In contrast, in the present example embodiment in which the supply speed of the lubricant was made higher at each of the end parts than the center part of the stay 1 in the longitudinal direction, the lubricant did not become insufficient at the non-sheet-passing portion when the recording materials of A5 size passed, and the torque was not increased. As a result, an excellent conveyance performance was achieved.

In the present example embodiment, the configuration in which the lubricant storage portion 15 and the lubricant supplying portion 14 are each divided into the three parts having the same length in the longitudinal direction has been described as an example; however, the configuration is not limited to the case where the divided parts have the same length, and the number of divided parts is not limited to three. For example, the lubricant storage portion 15 may not be divided in the longitudinal direction. In the present example embodiment, since the conveyance position of the recording material in the longitudinal direction is based on the center alignment in which the center of the sheet in the sheet width direction is aligned in any of the large-sized sheet and the small-sized sheet, the configuration corresponding to the three areas of the center part and the both end parts has been used; however, a configuration corresponding to a larger odd number of areas may also be used. In a case where the conveyance position of the recording material in the longitudinal direction is based on an end alignment in which one end position is aligned in any of the large-sized sheet and the small-sized sheet, a configuration corresponding to two areas or a larger number of areas may also be used. In the case of the end alignment, the end positions of sheets of all sizes are the same on an alignment side. In other words, if the small-sized sheet passes, an end part on a side opposite to the reference side becomes the non-sheet-passing portion. Accordingly, the supply speed of the lubricant at the end part on the opposite side is made higher than the supply speed of the lubricant at the end part on the reference side.

In the first example embodiment, there has been described the configuration in which the density of the lubricant supplying portion 14 is changed to make the supply speed of the lubricant different between the longitudinal end parts, which are the non-sheet-passing portions, and the longitudinal center part, which is the sheet-passing portion, in the longitudinal direction of the stay 1. In a first modification, there is described a configuration in which the supply speed of the lubricant is made different between the longitudinal end parts, which are the non-sheet-passing portions, and the longitudinal center part, which is the sheet-passing portion, in the longitudinal direction of the stay 1 by changing the area of the opening of the lubricant storage portion and the contact area of the lubricant supplying portion with the film. The first modification has the configuration similar to the configuration according to the first example embodiment except for the density of the lubricant supplying portion, the area of the opening of the lubricant storage portion, and the contact area of the lubricant supplying portion with the film. In the descriptions below, differences are described, and components similar to the components according to the first example embodiment are indicated by the similar reference numerals and are not described.

Figure 7:
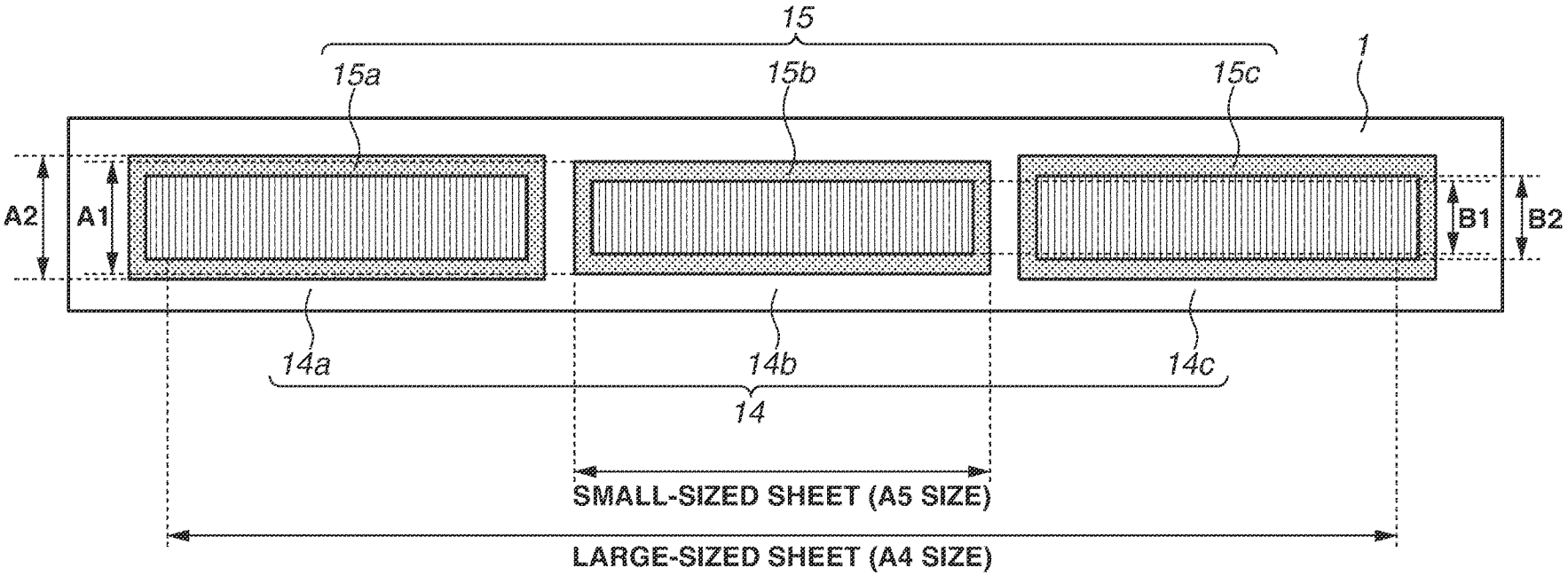
FIG. 7 is a diagram illustrating a longitudinal layout of a lubricant storage portion and a lubricant supplying portion according to a first modification.

FIG. 7 is a diagram illustrating layout of the lubricant storage portion 15 and the lubricant supplying portion 14 in the longitudinal direction according to the present modification. In the first modification, the lubricant storage portion 15 and the lubricant supplying portion 14 are each divided into three parts in the longitudinal direction, as with the first example embodiment. More specifically, the lubricant supplying portion 14 includes the lubricant supplying portion 14*b* located at the center part of the stay 1 in the longitudinal direction, and the lubricant supplying portions 14*a* and 14*c* located at the end parts. The lubricant storage portion 15 includes the lubricant storage portion 15*b* located at the center part of the stay 1 in the longitudinal direction, and the lubricant storage portions 15*a* and 15*c* located at the end parts. The detailed configuration of the lubricant storage portions 15*a*, 15*b*, and 15*c* is described below.

In the present modification, the lubricant stored in the lubricant storage portion 15*b* located at the longitudinal center part and the lubricant stored in the lubricant storage portions 15*a* and 15*c* located at the longitudinal end parts are the same, as with the first example embodiment. More specifically, the lubricant stored in the lubricant storage portions 15*a*, 15*b*, and 15*b* has a ½-scale incorporation consistency of 280 measured by a method specified by JIS K 2220. On the other hand, unlike the first example embodiment, the lubricant supplying portion 14*b* located at the longitudinal center part and the lubricant supplying portions 14*a* and 14*c* located at the longitudinal end parts are made of the same material and have the same density in the present modification. More specifically, the density of each of the lubricant supplying portions 14*a*, 14*b*, and 14*c* is set to 200 $g/m^2$ at the thickness of 1 mm.

The lubricant storage portions 15*a*, 15*b*, and 15*c* are described in detail below with reference to FIG. 7. In the present modification, the lubricant storage portions 15*a* and 15*c* and the lubricant supplying portions 14*a* and 14*c* that are located at the longitudinal end parts are each configured so that an outer end extends to outside of a sheet end of the large-sized sheet (A4 size). Further, the lubricant storage portions 15*a* and 15*c* and the lubricant supplying portions 14*a* and 14*c* that are located at the longitudinal end parts are each configured so that an inner end extends to a sheet end of the small-sized sheet (A5 size). In other words, the lubricant storage portions 15*a* and 15*c* and the lubricant supplying portions 14*a* and 14*c* that are located at the longitudinal end parts are disposed at positions corresponding to areas through which the large-sized sheet passes but the small-sized sheet does not pass. On the other hand, the lubricant supplying portion 14*b* located at the longitudinal center part has a length corresponding to a sheet width of the small-sized sheet (A5 size) in the longitudinal direction, and is disposed at a position corresponding to a sheet-passing portion through which both the large-sized sheet and the small-sized sheet pass.

On the other hand, the area of the opening of each of the lubricant storage portions 15*a* and 15*c* located at the longitudinal end parts is made larger than the area of the opening of the lubricant storage portion 15*b* located at the longitudinal center part. More specifically, the lubricant storage portions 15*a*, 15*b*, and 15*c* have the same length in the longitudinal direction, and a width B1 of the opening of the lubricant storage portion 15*b* is set to 3.0 min and a width B2 of the opening of each of the lubricant storage portions 15*a* and 15*c* is set to 3.3 mm. In this way, in the rotation direction of the film 2, the opening width (gap) B2 of the opening of each of the lubricant storage portions 15*a* and 15*c* located at the longitudinal end parts is made larger than the opening width (gap) B1 of the opening of the lubricant storage portion 15*b* located at the longitudinal center part, thereby the areas thereof are made different. The lubricant supplying portions 14*a*, 14*b*, and 14*c* have the same length in the longitudinal direction. On the other hand, in the rotation direction of the film 2, a length A1 of the peripheral surface of the film 2 in a contact area of the film 2 with the lubricant supplying portion 14*b* is set to 4.5 mm, and a length A2 of the peripheral surface of the film 2 in a contact area of the film 2 with each of the lubricant supplying portions 14*a* and 14*c* is set to 4.9 mm. In this way, in the rotation direction of the film 2, the contact area of the film 2 with the lubricant supplying portion 14*b* located at the longitudinal center part is made different from the contact area of the film 2 with each of the lubricant supplying portions 14*a* and 14*c* located at the longitudinal end parts.

In this configuration, the area of the opening of the lubricant storage portion 15 is made larger at the longitudinal ends than at the longitudinal center part, and the length A2 of the peripheral surface of the film 2 in contact with the lubricant supplying portion 14 is made larger at the longitudinal end parts than at the longitudinal center part. More specifically, in the present modification, the area of the opening and the length A2 of the peripheral surface at each of the longitudinal end parts are about 1.1 times the area of the opening and the length A2 of the peripheral surface at the longitudinal center part. As a result, the supply speed of the lubricant at the longitudinal center part is set to 0.16 mg/h, the supply speed of the lubricant at each of the longitudinal end parts is set to 0.19 mg/h, and the supply speed of the lubricant at each of the longitudinal end parts is set to about 1.2 times the supply speed of the lubricant at the longitudinal center part. As described above, when the supply speed of the lubricant at each of the longitudinal end parts is made higher than the supply speed of the lubricant at the longitudinal center part, the lubricant does not become insufficient at the non-sheet-passing portion, and the torque is not increased even in the case where a large number of small-sized sheets pass, as with the first example embodiment. As a result, an excellent conveyance performance can be achieved. In the present modification, a result similar to the result obtained in the first example embodiment was obtained as a result of a durability test similar to the durability test conducted in the first example embodiment, and it was confirmed that higher durability can be obtained compared with the configuration according to the conventional example.

In the present modification, both of the area of the opening of the lubricant storage portion 15 and the length A2 of the peripheral surface of the film 2 in contact with the lubricant supplying portion 14 are made different between the longitudinal center part and the longitudinal end parts; however, any one of the area of the opening of the lubricant storage portion 15 and the length A2 may be made different. Further, in the present modification, the opening width B2 of the opening of the lubricant storage portion 15 is not changed and is fixed in the single lubricant storage portion 15; however, the configuration is not limited thereto. The opening width B2 may be increased from the center toward each of the ends in the single lubricant storage portion 15. As described above, for example, the opening of each of the lubricant storage portions 15*a* and 15*c* located at the longitudinal end parts may have a trapezoidal shape in which an upper base is located on the longitudinal center side and a lower base is located on the longitudinal end side. In addition, the length A2 of the peripheral surface of the film 2 in contact with each of the lubricant supplying portions 14*a* and 14*c* in the rotation direction of the film 2 may be increased from the center to each of the ends in the longitudinal direction.

In the first example embodiment, there has been described the configuration in which the density of the lubricant supplying portion 14 is changed to make the supply speed of the lubricant different between the end parts, which are the non-sheet-passing portions, and the center part, which is the sheet-passing portion, in the longitudinal direction of the stay 1. In a second modification, there is described a configuration in which a consistency of the lubricant is changed to make the supply speed of the lubricant different between the end parts, which are the non-sheet-passing portions when the small-sized sheet passes, and the center part, which is the sheet-passing portion when the small-sized sheet passes, in the longitudinal direction of the stay. The second modification has the configuration similar to the configuration according to the first example embodiment except for the density of the lubricant supplying portion and the consistency of the lubricant. In the descriptions below, differences are described, and components similar to the components according to the first example embodiment are indicated by the similar reference numerals and are not described again.

In the second modification, the lubricant storage portion 15 and the lubricant supplying portion 14 are each divided into three parts in the longitudinal direction, similar to the first example embodiment. More specifically, the lubricant supplying portion 14 includes the lubricant supplying portion 14*b* located at the center part of the stay 1 in the longitudinal direction, and the lubricant supplying portions 14*a* and 14*c* located at the end parts. The lubricant storage portion 15 includes the lubricant storage portion 15*b* located at the center part of the stay 1 in the longitudinal direction, and the lubricant storage portions 15*a* and 15*c* located at the end parts.

The lubricant storage portions 15*a* and 15*c* and the lubricant supplying portions 14*a* and 14*c* that are located at the longitudinal end parts are each configured so that an outer end extends to outside of a sheet end of the large-sized sheet (A4 size). Further, the lubricant storage portions 15*a* and 15*c* and the lubricant supplying portions 14*a* and 14*c* that are located at the longitudinal end parts are each configured so that an inner end extends to a sheet end of the small-sized sheet (A5 size). In other words, the lubricant storage portions 15*a* and 15*c* and the lubricant supplying portions 14*a* and 14*c* that are located at the longitudinal end parts are disposed at positions corresponding to areas through which the large-sized sheet passes but the small-sized sheet does not pass. On the other hand, the lubricant supplying portion 14*b* located at the center part of the stay 1 in the longitudinal direction has a length corresponding to a sheet width of the small-sized sheet (A5 size) in the longitudinal direction, and is disposed at a position corresponding to a sheet-passing portion through which both the large-sized sheet and the small-sized sheet pass.

In the present modification, the opening of each of the lubricant storage portions 15*a* and 15*c* located at the longitudinal end parts and the opening of the lubricant storage portion 15*b* located at the center part of the stay 1 in the longitudinal direction have the same area, as with the first example embodiment. More specifically, the lubricant storage portions 15*a*, 15*b*, and 15*c* have the same length in the longitudinal direction, and the opening width (gap) B of the opening of the lubricant storage portion 15 in the rotation direction of the film 2 is set to 3.0 mm. Further, the contact area of the film 2 with the lubricant supplying portion 14*b* located at the center part of the stay 1 in the longitudinal direction and the contact area of the film 2 with each of the lubricant supplying portions 14*a* and Mc located at the longitudinal end parts are equal to each other, as with the first example embodiment. More specifically, the lubricant supplying portions 14*a*, 14*b*, and 14*c* have the same length in the longitudinal direction, and the length A of the peripheral surface of the film 2. in each of the contact areas of the film 2 with the lubricant supplying portions 14*a*, 14*b*, and 14*c* in the rotation direction of the film 2 is set to 4.5 mm.

Further, in the present modification, unlike the first example embodiment, the lubricant supplying portion 14*b* located at the longitudinal center part and the lubricant supplying portions 14*a* and 14*c* located at the longitudinal end parts are made of the same material and have the same density. More specifically, the density of each of the lubricant supplying portions 14*a*, 14*b*, and 14*c* is set to 200 g/m$^2$ at the thickness of 1 mm.

In the present modification, two types of lubricant different in consistency are used. More specifically, a lubricant with a high consistency (and a low viscosity) is stored in the lubricant storage portions 15*a* and 15*c* located at the longitudinal end parts, and a lubricant with a low consistency (and a high viscosity) is stored in the lubricant storage portion 15*b* located at the longitudinal center part. The lubricant stored in the lubricant storage portions 15*a*, 15*b*, and 15*c* are respectively supplied to the film 2 through the lubricant supplying portions 14*a*, 14*b*, and 14*c*. The lubricant stored in the lubricant storage portion 15*b* located at the center part of the stay 1 in the longitudinal direction has a ½-scale incorporation consistency of 280 measured by a method specified by JIS K 2220. On the other hand, the lubricant stored in the lubricant storage portions 15*a* and 15*c* located at the longitudinal end parts has a ½-scale incorporation consistency of 330 measured by the method specified by JIS K 2220. The consistency of the lubricant is adjusted by changing a compounding ratio of the base oil and the fluororesin as a thicker. As a result, the supply speed of the lubricant at the longitudinal center part is set to 0.16 mg/h, the supply speed of the lubricant at each of the longitudinal end parts is set to 0.19 mg/h, and the supply speed of the lubricant at each of the longitudinal end parts is set to about 1.2 times the supply speed thereof at the longitudinal center part. As described above, when the supply speed of the lubricant at each of the longitudinal end parts is made higher than the supply speed of the lubricant at the longitudinal center part, the lubricant does not become insufficient at the non-sheet-passing portion, and the torque is not increased even in the case where a large number of small-sized sheets pass, as with the first example embodiment. As a result, an excellent conveyance performance can be achieved. In the present modification, a result similar to the result obtained in the first example embodiment was obtained as a result of a durability test similar to the durability test conducted in the first example embodiment, and it was confirmed that higher durability can be obtained compared with the configuration according to the conventional example.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-245432, filed Dec. 27, 2018, which is hereby incorporated by reference herein in its entirety.

What is claimed is:

1. An image heating device for heating an image formed on a recording material, comprising:

a heating member elongated in a longitudinal direction;

a supporting member configured to support the heating member;

an endless film configured to be guided by the supporting member and to be rotated around the heating member, and including an inner peripheral surface sliding with respect to the heating member; and a rotating member configured to come into contact with an outer peripheral surface of the film and form a nip portion that nips and conveys the recording material carrying the image while heating the image on the recording material, wherein the supporting member includes a lubricant storage portion configured to store a lubricant on an upstream side of the nip portion in a rotation direction of the film, wherein the supporting member further includes a lubricant supplying portion configured to supply the lubricant stored in the lubricant storage portion to the inner peripheral surface of the film, wherein an amount of the lubricant supplied from the lubricant supplying portion to the inner peripheral surface of the film per unit time is larger in an area through which a small-sized recording material smaller than a maximum-sized recording material fixable by the image heating device does not pass in the longitudinal direction than in an area through which the small-sized recording material passes, wherein the lubricant storage portion includes a first lubricant storage portion corresponding to the area through which the small-sized recording material passes and a second lubricant storage portion corresponding to the area through which the small-sized recording material does not pass in the longitudinal direction when the small-sized recording material is conveyed to the image heating device, and wherein the lubricant supplying portion includes a first lubricant supplying portion configured to supply the lubricant stored in the first lubricant storage portion to the inner peripheral surface of the film, and a second lubricant supplying portion configured to supply the lubricant stored in the second lubricant storage portion to the inner peripheral surface of the film.

2. The image heating device according to claim 1, wherein the first lubricant supplying portion and the second lubricant supplying portion allows the lubricant to permeate therethrough, and wherein the second lubricant supplying portion has a density smaller than a density of the first lubricant supplying portion.

3. The image heating device according to claim 1, wherein the first lubricant storage portion supplies the lubricant to the first lubricant supplying portion through a first opening, wherein the second lubricant storage portion supplies the lubricant to the second lubricant supplying portion through a second opening, and wherein an opening width of the second opening in the rotation direction of the film is larger than an opening width of the first opening.

4. The image heating device according to claim 3, wherein the second opening has an area larger than an area of the first opening.

5. The image heating device according to claim 1, wherein a length in the rotation direction of the film of an area where the second lubricant supplying portion comes into contact with the film is larger than a length in the rotation direction of the film of an area where the first lubricant supplying portion comes into contact with the film.

6. The image heating device according to claim 5, wherein the area where the second lubricant supplying portion comes into contact with the film is larger than the area where the first lubricant supplying portion comes into contact with the film.

7. The image heating device according to claim 1, wherein the first lubricant storage portion stores a first lubricant, and wherein the second lubricant storage portion stores a second lubricant that is higher in consistency than the first lubricant.

8. An image heating device for heating an image formed on a recording material while the recording material is being conveyed at a nip portion, comprising:

a rotatable endless film;

a guide member configured to guide the film, the guide member being in contact with an inner peripheral surface of the film;

a roller contacting an outer peripheral surface of the film, the roller forms the nip portion in cooperation with the guide member via the film;

a first lubricant storage portion configured to store a lubricant, the first lubricant storage portion being provided at a position of the guide member corresponding to an area through which a small-sized recording material smaller than a maximum-sized recording material usable by the image heating device passes in a generatrix direction of the film;

a first lubricant supplying portion configured to supply the lubricant stored in the first lubricant storage portion to the inner peripheral surface of the film;

a second lubricant storage portion configured to store the lubricant, the second lubricant storage portion being provided at a position of the guide member corresponding to an area through which the small-sized recording material does not pass in the generatrix direction of the film, and a second lubricant supplying portion configured to supply the lubricant stored in the second lubricant storage portion to the inner peripheral surface of the film, wherein an amount of the lubricant supplied from the second lubricant supplying portion to the inner peripheral surface of the film per unit time is larger than an amount of the lubricant supplied from the first lubricant supplying portion to the inner peripheral surface of the film per unit time.

9. The image heating device according to claim 8, wherein the first lubricant supplying portion and the second lubricant supplying portion allows the lubricant to permeate therethrough, and wherein the second lubricant supplying portion has a density smaller than a density of the first lubricant supplying portion.

10. The image heating device according to claim 8, wherein the first lubricant storage portion supplies the lubricant to the first lubricant supplying portion through a first opening, wherein the second lubricant storage portion supplies the lubricant to the second lubricant supplying portion through a second opening, and wherein an opening width of the second opening in a rotation direction of the film is larger than an opening width of the first opening.

11. The image heating device according to claim 10, wherein the second opening has an area larger than an area of the first opening.

12. The image heating device according to claim 8, wherein a length in a rotation direction of the film of an area where the second lubricant supplying portion comes into contact with the film is larger than a length in the rotation direction of the film of an area where the first lubricant supplying portion comes into contact with the film.

13. The image heating device according to claim 12, wherein the area where the second lubricant supplying portion comes into contact with the film is larger than the area where the first lubricant supplying portion comes into contact with the film.

14. The image heating device according to claim 8, wherein the first lubricant storage portion stores a first lubricant, and wherein the second lubricant storage portion stores a second lubricant that is higher in consistency than the first lubricant.

15. The image heating device according to claim 8, wherein the guide member includes a heater.

16. The image heating device according to claim 15, wherein the nip portion is formed by the roller in cooperation with the heater via the film.

* * * * *